US006263886B1

(12) United States Patent
Davis

(10) Patent No.: US 6,263,886 B1
(45) Date of Patent: Jul. 24, 2001

(54) HAIR STYLING TOOL

(76) Inventor: Lisa Davis, 3715 S. Raino Cir., Las Vegas, NV (US) 89103

( * ) Notice: Subject to any disclaimer, the term of this patent is extended or adjusted under 35 U.S.C. 154(b) by 0 days.

(21) Appl. No.: 09/586,675

(22) Filed: Jun. 1, 2000

(51) Int. Cl.[7] ..... A45D 8/00; A45D 8/20; A45D 8/04

(52) U.S. Cl. ..... 132/276; 132/273; 132/277

(58) Field of Search ..... 132/276, 277, 132/278, 273, 279, 280–284, 236, 241, 243, 244, 150, 145; 24/556, 543

(56) References Cited

U.S. PATENT DOCUMENTS

| | | | | |
|---|---|---|---|---|
| D. 132,140 | * | 4/1942 | Schlicker | 132/254 |
| 846,813 | | 3/1907 | Weiler . | |
| 1,462,167 | | 7/1923 | Crooms . | |
| 1,570,141 | | 1/1926 | Glantz . | |
| 1,590,746 | * | 6/1926 | Hoppmann | 132/243 |
| 1,756,837 | * | 4/1930 | Shelton | 132/236 |
| 1,806,248 | * | 5/1931 | Freeman et al. | 132/236 |
| 1,874,630 | | 8/1932 | Samantas . | |
| 2,323,254 | * | 6/1943 | Sterling | 132/243 |
| 2,485,686 | * | 10/1949 | Bacon | 132/249 |
| 2,509,658 | * | 5/1950 | Wallace | 132/244 |
| 3,841,340 | * | 10/1974 | Solomon | 132/241 |
| 4,163,143 | | 7/1979 | Federico et al. . | |
| 5,012,830 | | 5/1991 | Vaccaro et al. . | |
| 5,305,767 | | 4/1994 | Ivanov . | |
| 5,533,533 | * | 7/1996 | Shing | 132/279 |
| 5,558,104 | | 9/1996 | Clouser . | |
| 5,626,153 | * | 5/1997 | Petrarca | 132/270 |
| 5,816,267 | * | 10/1998 | Chou | 132/145 |
| 6,019,108 | * | 2/2000 | Chen | 132/276 |

* cited by examiner

*Primary Examiner*—John J. Wilson
*Assistant Examiner*—Robyn Kieu Doan
(74) *Attorney, Agent, or Firm*—Robert Ryan Morishita Anderson & Morishita

(57) ABSTRACT

A device for styling hair includes means for dividing a section of hair attached to means for retaining a section of hair. Optionally, the dividing means is a tapered extension and the retaining means is a clip. Optionally, the tapered extension and clip are integrally formed. The clip optionally includes two opposable jaws pivotally connected. The clip may further include a spring biased to close the jaws and an actuator moving the jaws between an open position and a closed position when actuated.

11 Claims, 2 Drawing Sheets

HAIR STYLING TOOL

FIELD OF THE INVENTION

The present invention relates to hair styling tools. Specifically, the present invention is a hair styling tool that allows the user to section hair and retain the sectioned hair with a single tool.

BACKGROUND OF THE INVENTION

It is well known in the art that many hair styling procedures, such as cutting, blow styling, coloring, and chemical work, require the sectioning of the hair and the subsequent retention of the sectioned hair to facilitate working with either the sectioned hair or the remaining hair. When sectioning hair, the hair stylist uses comb, such as a rat-tail comb, to part a layer of hair. The stylist lifts the sectioned hair from the customer's scalp. The sectioned hair is grasped in the free hand and the rat-tail comb is released from the other hand, usually by putting the comb in the stylist's pocket, on a surface, or in the stylist's mouth. The hand formerly holding the comb picks up a clip and the sectioned hair is retained in the clip to keep it separated from the other sectioned hair and the remainder of the hair. The procedure is then repeated until the hair is sectioned as the styling procedure requires.

It is apparent that the procedure of the prior art is time consuming and inefficient due to the repeated transfers of tools between hands. The procedure and devices of the prior art have other drawbacks as well. First, to facilitate the sectioning and clipping, many stylists clip the clips to their shirt for easy access. The repeated clipping and unclipping of the clips to the stylist's clothing, however, causes wear to the stylist's clothing.

Moreover, as alluded to above, to speed the sectioning and clipping process, many stylists temporarily hold the comb in their mouths while clipping the hair. This can be unsanitary and, possibly, hazardous to the stylist when working with chemicals such as dyes.

While many improvements have been made to hair clips, there remain drawbacks to the devices of the prior art. Many conventional clips are intended to be worn as ornamentation or for holding part of a hair style in place. In other words, these clips are not suitable for temporary use while styling or coloring hair. Moreover, these clips are used in the same way as the clips described above. That is, a stylist using these clips must alternate between a comb and a clip when alternately sectioning and clipping the hair.

One clip known in the prior art includes a tapered lower jaw that is intended to be used to section the hair. However, the drawback of this clip is that the stylist must hold the clip open while sectioning the hair. This can cause wear on the clip and the clip spring, as well as being inconvenient to the stylist. Moreover, because the clip must be held open while sectioning the hair, this method and device can also cause repetitive stress injuries to the stylist's arm, hand, and wrist such as tennis elbow and carpal tunnel.

It can be seen, therefore, that there is a need in the art for a hair styling tool that can be used in an efficient and sanitary manner to section hair and retain the sectioned hair.

SUMMARY OF THE INVENTION

A device for sectioning hair and retaining a section of hair includes a means for dividing a section of hair and a means for retaining a section of hair attached to the dividing means. Optionally, the dividing means is a tapered extension and the retaining means is a clip having two opposable jaws that are movable between an open position and a closed position. In an optional embodiment, the dividing means and the retaining means are integrally formed.

In an embodiment in which the retaining means is a clip, the clip may optionally include opposable jaws pivotable between an open position and a closed position. More specifically, the clip may optionally have a first jaw and a second jaw. The first and second jaws are pivotally connected to one another about an axis by a pivot. The clip may further include an actuator connected to at least one of said jaws for moving the jaws of the clip between an open position and a closed position when actuated. Optionally, the clip further includes a spring biased to hold the jaws in the closed position.

As described above, the dividing means may be a tapered extension. The tapered extension may extend from the clip in any direction. However, in an optional embodiment, the tapered extension may extend perpendicular to the pivotal axis. Alternatively, the tapered extension may extend parallel to the pivotal axis. The tapered extension optionally attaches to, and extends from, the actuator.

It is an object of the present invention to provide a single tool for sectioning hair and retaining the sectioned hair.

DESCRIPTION

Figure 1:
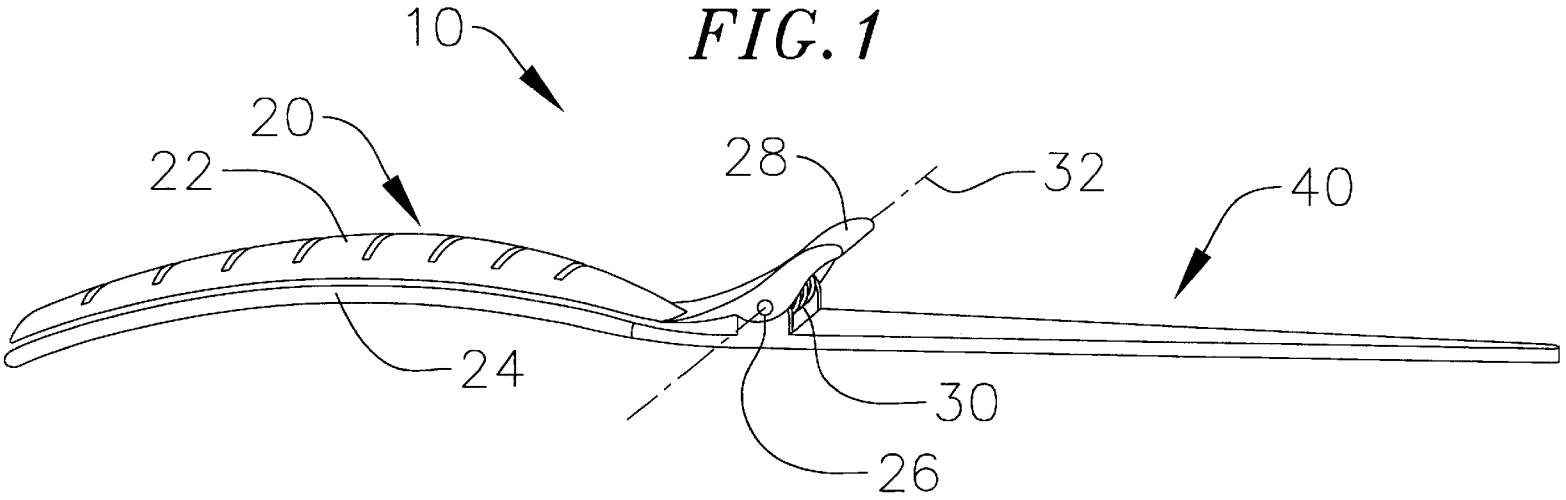
FIG. 1 is an elevated perspective view of an embodiment of the hair styling tool of the present invention.
Figure 2:
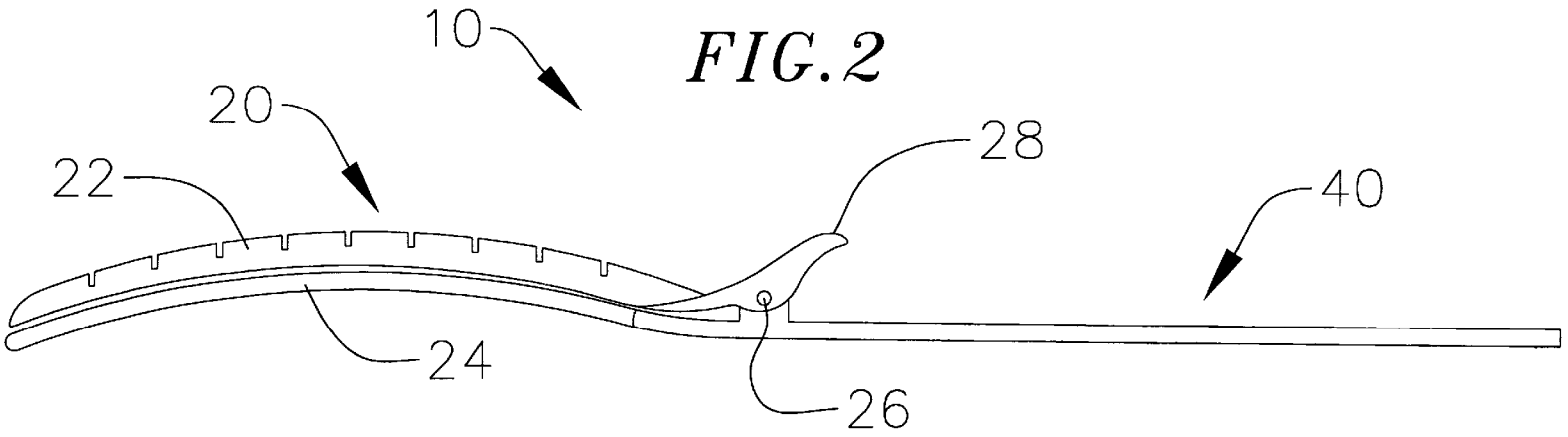
FIG. 2 is a side view of the embodiment of FIG. 1 with the clip in the closed position.
Figure 3:
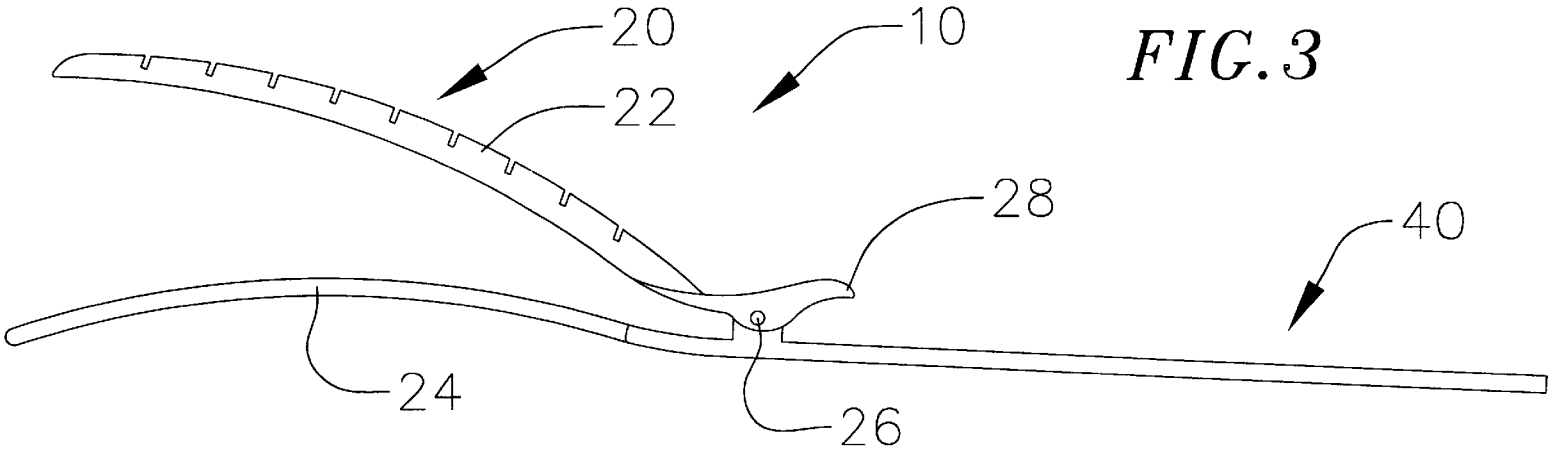
FIG. 3 is a side view of the embodiment of FIG. 1 with the clip in the open position.
Figure 4:
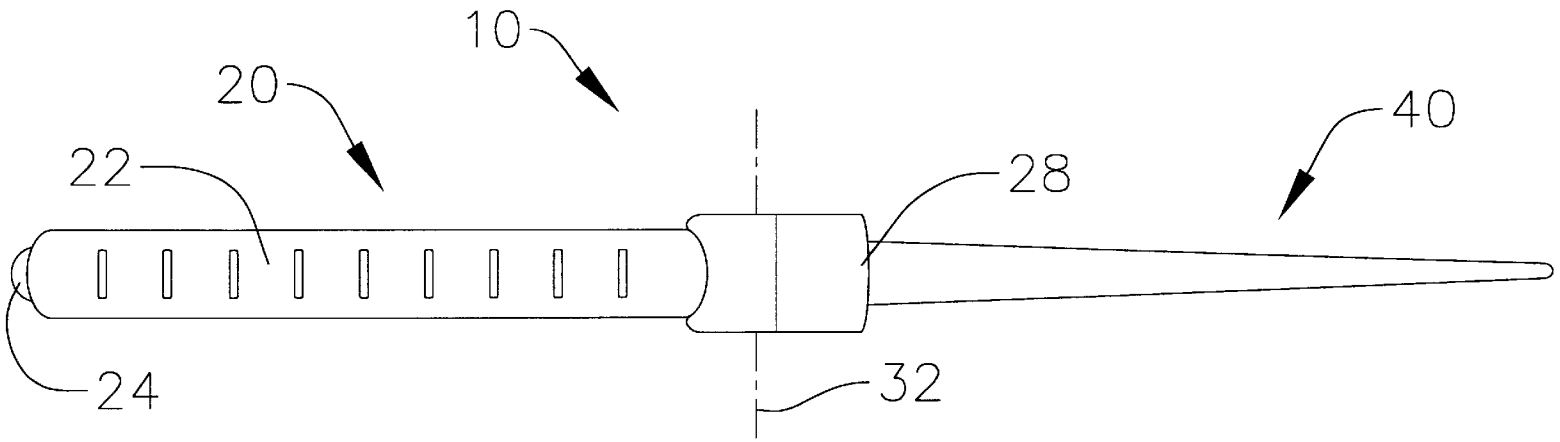
FIG. 4 is a top view of the embodiment of FIG. 1 with the clip in the closed position.

Reference is now made to the figures wherein like parts are referred to by like numerals throughout. With reference to FIGS. 1–4, the hair tool 10 of the present invention includes a means for dividing a section of hair attached to a means for retaining the hair.

The retaining means could be any type of retainer or clip known in the prior art. For example, the retaining means could be a clip, pin, or the like. In an optional embodiment, the retaining means is a clip 20.

As shown in FIGS. 1–4, the clip 20 optionally includes two opposable jaws, a first jaw 22 and a second jaw 24. Hair is retained by securing the hair between the jaws 22, 24. The jaws 22, 24 are optionally connected by a pivot 26 to allow the jaws 22, 24 to be pivoted about a pivotal axis 32 between a closed position, shown in FIG. 2, and an open position, shown in FIG. 3. Referring again to FIGS. 1–4, the clip 20 optionally includes one or more actuators 28 to facilitate opening the clip 20. Likewise, the clip 20 may optionally include a spring 30 biased close the clip 20 and hold the clip 20 in the closed position. In other words, in the optional embodiment of FIGS. 1–4, the spring 30 is deformed when the actuator 28 is actuated to open the jaws 22, 24. When the actuator 28 is released, the spring 30 closes the jaws 22, 24 and holds the jaws 22, 24 closed.

The dividing means could be a variety of structures known in the art, including a rat-tail comb, a tapered handle, or the like. In an optional embodiment, of FIGS. 1–4, the dividing means is a tapered extension 40 attached to, and extending longitudinally from, the clip 20. The tapered extension 40 optionally tapers from the width of the clip 20 at the point of attachment to a rounded point at its end.

The dividing means and the retaining means may be removably or permanently attached by any method known in the prior art, including bonding, soldering, adhering, interference fitting, or the like, or by using fastening devices known in the art such as mechanical fasteners, rivets, or the like. In the optional embodiment of FIGS. 1–4, the dividing means and the retaining means are integrally formed. That is, in the optional embodiment of FIGS. 1–4 the lower jaw 24 of the clip 20 is integrally formed with a tapered extension 40 extending from the jaw 24. In an alternate optional embodiment, the tapered extension 40 may be movable, such as by pivoting, to a storage position to make the hair tool 10 more compact. Likewise, the tapered extension 40 may be removably attached to the clip 20.

While the optional embodiment of FIGS. 1–4 includes a tapered extension 40 extending perpendicular to the pivotal axis 32 of the clip 20, the tapered extension 40 and the clip 20 may be oriented such that the tapered extension 40 is perpendicular, parallel, or skew in relation to the pivotal axis 32 of the clip 20.

In use, the hair stylist divides a section of hair using the dividing means then, using the attached retaining means, retains the section of hair. According to the optional embodiment of the present hair tool 10 of FIGS. 1–4, the hair stylist divides a section of hair by drawing the tapered extension 40 along the client's scalp to part the client's hair. The section of hair along one side of the part is grasped in the stylist's hand. The stylist reverses the hair tool 10 and opens the clip 20 by depressing the actuator 28 to pivot the jaws 22, 24 to an open position. The section of hair is placed between the jaws 22, 24 and the actuator 28 is released. When the actuator 28 is released, the spring 30 closes the jaws 22, 24 and hold the jaws 22, 24 closed, thereby retaining the section of hair in the clip 20. The stylist then picks up another hair tool 10 according to the present invention and repeats the process of dividing a section of hair and retaining the section of hair. After completing the styling or chemical work, the stylist removes the hair tool 10 of the present invention from the client's hair by depressing the actuator 28 to open the jaws 22, 24 and release the hair from the clip 20.

While certain embodiments of the present invention have been shown and described it is to be understood that the present invention is subject to many modifications and changes without departing from the spirit and scope of the claims presented herein.

I claim:

1. A device for sectioning hair and retaining a section of hair, comprising:

a clip comprising opposable arcuate first and second jaws pivotable between an open position and a closed position, and a pivot securing the first jaw to the second jaw proximate the end of said jaws; and a tapered extension attached at the pivot of said clip, the taper of said extension beginning at said pivot.

2. The device of claim 1 wherein said clip further comprises a spring coincident with said pivot biased to close said jaws.

3. The device of claim 1 wherein said clip further comprises an actuator connected to at least one of the jaws, the actuator moving the jaws between an open position and a closed position when actuated.

4. The device of claim 1 wherein said clip and said tapered extension are integrally formed.

5. A device for sectioning hair and retaining a section of hair temporarily while working with the hair, comprising:

a clip having opposable arcuate first and second jaws pivotally connected about an axis by a pivot proximate the end of said jaws, and an actuator connected to at least one of said jaws, the actuator pivoting the jaws of said clip between an open position and a closed position when actuated; and a tapered extension attached at the pivot of said clip, the taper of said extension beginning at said pivot.

6. The device of claim 5 wherein said clip further comprises a spring coincident with said pivot biased to close said jaws.

7. The device of claim 5 wherein said clip and said tapered extension are integrally formed.

8. The device of claim 5 wherein said tapered extension extends perpendicular to said pivotal axis.

9. The device of claim 5 wherein said tapered extension extends parallel to said pivotal axis.

10. The device of claim 5 wherein said tapered extension is attached to, and extends from, said actuator.

11. A device for sectioning hair and retaining a section of hair temporarily while working with the hair, comprising:

a clip having opposable arcuate first and second jaws pivotally connected about an axis by a pivot proximate the end of said jaws, an actuator connected to at least one of said jaws, the actuator pivoting the jaws of said clip between an open position and a closed position when actuated, and a spring coincident with said pivot biasing the first and second jaws into a closed position; and a tapered extension attached at the pivot of said clip, the taper of said extension beginning at the pivot.

* * * * *